US006193338B1

(12) United States Patent
Kocer

(10) Patent No.: US 6,193,338 B1
(45) Date of Patent: Feb. 27, 2001

(54) COMPUTER DESK

(76) Inventor: Bruce Kocer, 290 Oxford Lake Dr., Oxford, MI (US) 48371

( * ) Notice: Subject to any disclaimer, the term of this patent is extended or adjusted under 35 U.S.C. 154(b) by 0 days.

(21) Appl. No.: 09/293,241

(22) Filed: Apr. 16, 1999

Related U.S. Application Data

(60) Provisional application No. 60/082,120, filed on Apr. 17, 1998.

(51) Int. Cl.[7] ..... A47B 17/00
(52) U.S. Cl. ..... 312/194; 312/195
(58) Field of Search ..... 312/238, 239, 312/194, 195, 223.3; D6/422, 425, 427, 428

(56) References Cited

U.S. PATENT DOCUMENTS

| | | | |
|---|---|---|---|
| D. 281,293 | | 11/1985 | Johnston . |
| D. 283,092 | | 3/1986 | Johnston . |
| D. 323,260 | | 1/1992 | Lewis . |
| D. 329,150 | | 9/1992 | Ball . |
| D. 330,124 | | 10/1992 | Short . |
| D. 338,787 | * | 8/1993 | Whitford ..... D6/437 |
| D. 342,626 | | 12/1993 | Golod et al. . |
| D. 345,063 | | 3/1994 | Golod et al. . |
| D. 355,547 | | 2/1995 | Liston . |
| D. 357,599 | | 4/1995 | Kelley . |
| D. 368,180 | | 3/1996 | Ball . |
| D. 371,029 | | 6/1996 | Pagett . |
| D. 371,255 | | 7/1996 | Richard . |
| D. 371,468 | | 7/1996 | Sittel et al. . |
| D. 372,601 | | 8/1996 | Roberts et al. . |
| D. 381,222 | | 7/1997 | O'Sullivan et al. . |
| D. 381,530 | | 7/1997 | O'Sullivan et al. . |
| D. 386,015 | | 11/1997 | O'Sullivan et al. . |
| D. 391,415 | | 3/1998 | O'Sullivan et al. . |

FOREIGN PATENT DOCUMENTS

1761 * 1/1902 (GB) ..... 312/195

OTHER PUBLICATIONS

Broyhill's Home Office (page 1 of 2) Apr. 1998.

Elegant Birch Work Stations, Choose from Five user–friendly designs! (one page) Apr. 1998.

Creative Ideas "Your Complete Resource For Home/Office Furniture"—872DCT Deluxe Corner Desk with 800DCR Deluxe Corner Hutch, Feb. 1997.

Creative Ideas "Your Complete Resource For Home/Office Furniture"—872DCD Deluxe Corner Desk, Mar. 1996.

Home Office Furniture: The InterActive Desk—Information About the Design of the InterDesk, The Importance of Being Efficient, Storage Options, Office and Desk layouts for One Person, and Quotation Form: Find Out How Little Your Beautiful I–Desk Costs (12 pages) Apr. 1998.

Hooker & Rose Furniture Apr. 2, 1998 (1 page).

Bush Home Office Furniture, WC3730 Hampton Hutch for WC3702 (2 pages) 1997.

(List continued on next page.)

*Primary Examiner*—Janet M. Wilkens
(74) *Attorney, Agent, or Firm*—Gifford, Krass, Groh, Sprinkle, Anderson & Citkowski, PC

(57) ABSTRACT

A computer storing desk for housing and supporting computer hardware includes a C-shaped top with a concave side and an opposite convex side. The concave side defines a work area and the convex side is greater in length than the concave side and defines a front edge of the desk. The top also has two ends which extend between the concave and convex sides. A pedestal supports the top and is positioned under one end of the top. Inside of the pedestal is a storage space and one face of the pedestal has an access opening which communicates with the interior storage space. The pedestal has another face which is a solid face with no openings. The pedestal is positioned such that the solid face is aligned with the concave side of the top and the face with the access opening is aligned with one end of the top.

10 Claims, 18 Drawing Sheets

U.S. PATENT DOCUMENTS

| | | | | |
|---|---|---|---|---|
| 2,386,092 | * | 10/1945 | Cornish | 312/238 X |
| 4,766,422 | | 8/1988 | Wolters et al. . | |
| 4,836,623 | | 6/1989 | Holland . | |
| 5,121,974 | | 6/1992 | Monson . | |
| 5,242,217 | | 9/1993 | Gonnet . | |
| 5,437,235 | | 8/1995 | Randolph . | |
| 5,474,373 | | 12/1995 | Forester . | |
| 5,615,936 | * | 4/1997 | Simmons et al. | 312/194 X |
| 5,628,255 | | 5/1997 | Neuner . | |
| 5,634,409 | | 6/1997 | Pagett . | |
| 5,655,822 | | 8/1997 | Roberts et al. . | |

* cited by examiner

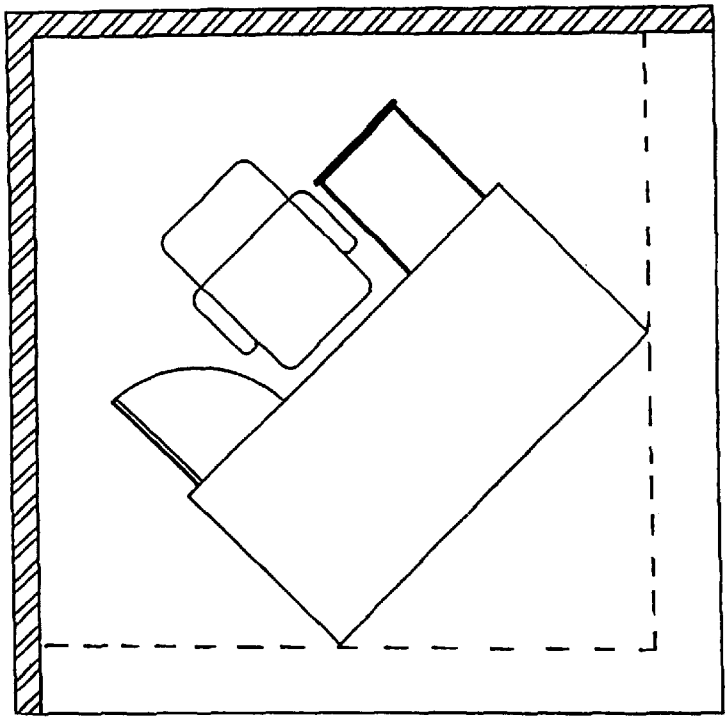
(PRIOR ART) FIGURE 13
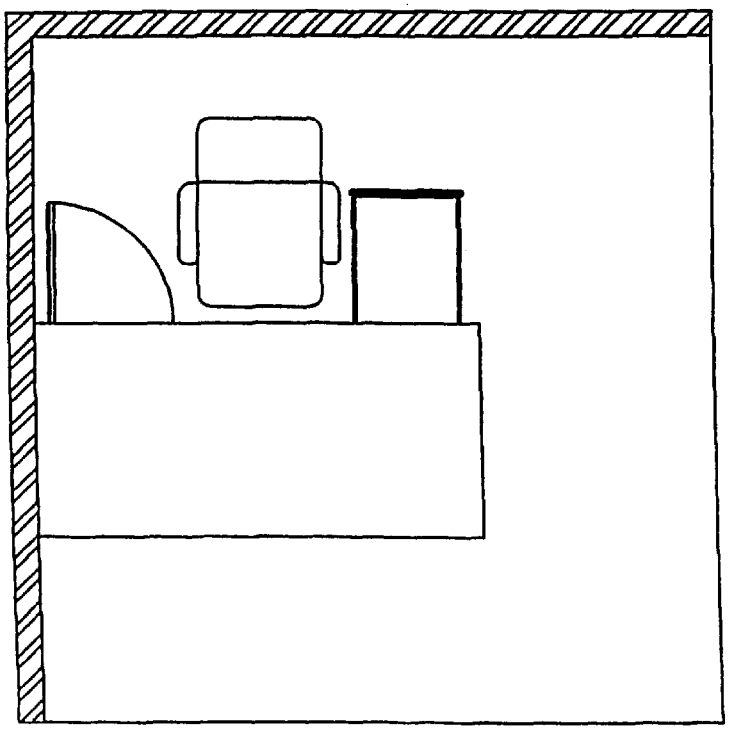
(PRIOR ART) FIGURE 14

COMPUTER DESK

CROSS-REFERENCE TO RELATED APPLICATIONS

This application claims the benefit of U.S. Provisional Application having Serial Number 60/082,120 filed Apr. 17, 1998.

FIELD OF THE INVENTION

This invention relates generally to desks and, more specifically, to computer desks that maximize the use of floor space through convenient packaging.

BACKGROUND OF THE INVENTION

Desks of various types have been used for a very long time and in that time their design has changed very little. Traditionally, desks have provided a plurality of drawers or storage bins for storing everything necessary for conducting business or personal affairs. This includes drawers specifically adapted to hold pens and pencils as well as drawers designed to hold hanging file folders. Desks come in a great variety of sizes and shapes but typically are rectangular and are 5 to 7 feet long, side to side, and 2-½ to 4 feet deep, front to back. Desks larger than this size require too much floor space for most offices and homes, and desks smaller than this size provide insufficient room both for storage inside the desk and for work space on top of the desk.

The advent and widespread adoption of computers has dramatically affected the conduct of both business and personal affairs. People now use computers for everything from letter writing and record keeping to recreation. Consequently, many people use their desk to support some or all of their computer hardware. Traditional desks are not well suited to accommodating computers. Home and business computers typically consist of at least four parts: a main processing unit, a monitor or display unit, a keyboard or data entry device, and a mouse or pointing device. Many additional devices may be used with and connected to a computer. These include output devices such as printers as well as input devices such as scanners. The various components usually need to be located near to one another and interconnected with cables. When a computer is used with a traditional desk, which has an upper work surface and a variety of storage spaces, a monitor is typically placed on top of the work surface so that it can be easily viewed by a person working or sitting at the desk. The keyboard and mouse may also be placed on the working surface of the desk. The main processing unit must either be placed on the desk surface or on the floor alongside the desk. This arrangement of the computer hardware components clutters the work surface of the desk and may also take up floor space if the main processing unit is placed on the floor. If a printer or scanner is attached to the computer, space must also be found for this device. If a printer is placed on the work surface, the work surface becomes even more cluttered. If the user wishes to place a printer or scanner elsewhere, room on a shelf, a credenza, or the floor must be found. This too increases the clutter in the area surrounding the desk.

Many people use desks for both computer activities and non-computer activities but do not wish to have the upper surface of the desk cluttered with computer components when they wish to work at the desk.

The advent and adoption of computers has created a demand for and increasing supply of desks and work stations specifically adapted to house and support various components of a computer system. Computer desks or work stations typically provide room to store some or all components of the computer system on or within the desk or work station, thereby reducing clutter. However, currently available designs have several shortcomings. In order for a computer desk or work station to have sufficient storage room for all components of a computer system, it must either be large and bulky, or must eliminate storage for items other than the computer hardware. The advent of computers has not eliminated the need for many of the objects used prior to the advent of computers such as pens, paper, files, and miscellanies such as paper clips and stamps. Therefore, to be most useful, a computer desk or work station must provide storage for the hardware components of a computer system as well as provide the traditional types of storage that people have come to expect, such as room for hanging file folders, pens, paper and envelopes. Currently available designs for computer desks and work stations fail to satisfy this need. This is partially because the acceptable size for a desk or work station is limited. Most consumers are not willing to accept a desk or work station that is larger than a traditional desk. In addition, many homes and offices do not have room for a larger desk.

One way in which designers of computer desks and work stations have attempted to address the needs of computer users, is to provide a desk with a upwardly extending portion which provides additional storage above the surface of the desk. This approach has the drawback that it tends to be unattractive and to physically dominate a room in which the work station resides. Also, the fact that part of the work station extends up above the traditional height of a desk limits its use for most situations to a position against the wall. If the work station were located out into the room, it would create a barrier between different portions of the room. Persons sitting on opposite sides of the work station would not be able to easily see each other or to converse as is possible across a traditional height desk. While positioning a work station against the wall may work with some office layouts and some decorating approaches, most users prefer not to face a wall when they work at a desk or work station for a long period of time. Most persons prefer to face outwardly into a room, which is not possible with work stations which extend upwardly to a height greater than a traditional desk.

There is a need for desks of traditional height which provide storage for computer hardware as well as accessories such as printers and also provide storage space for hanging file folders, paper and envelopes, and other items traditionally stored in a desk. It is desirable that such a desk not be overly large and fit well into a traditional office or room layout without dominating the room.

SUMMARY OF THE INVENTION

A computer storing desk according to the present invention overcomes many of the shortcomings of prior art desks. It includes a C-shaped top with a concave side which defines a work area and a convex side which is opposite to the concave side. The convex side is greater in length than the concave side and defines a front edge of the desk. The C-shaped top also has a first end and a second end which extend between the concave and convex sides. A pedestal, designed to support the top, is disposed under one end of the C-shaped top. The pedestal defines a storage space and has a first face with an access opening defined therein. The access opening communicates with the storage space. The pedestal also has a second face which is a solid face with no openings. The pedestal is positioned such that the second face is aligned with the concave side of the top and the first side is aligned with one of the ends.

BRIEF DESCRIPTION OF THE DRAWINGS

FIG. 13 is a plan view of a traditional rectangular desk positioned so as to face out from a corner of a room;

FIG. 14 is a plan view of a traditional rectangular desk shown positioned with one edge against a wall and facing out from a corner of the room;

DETAILED DESCRIPTION OF THE PREFERRED EMBODIMENTS

Figure 1:
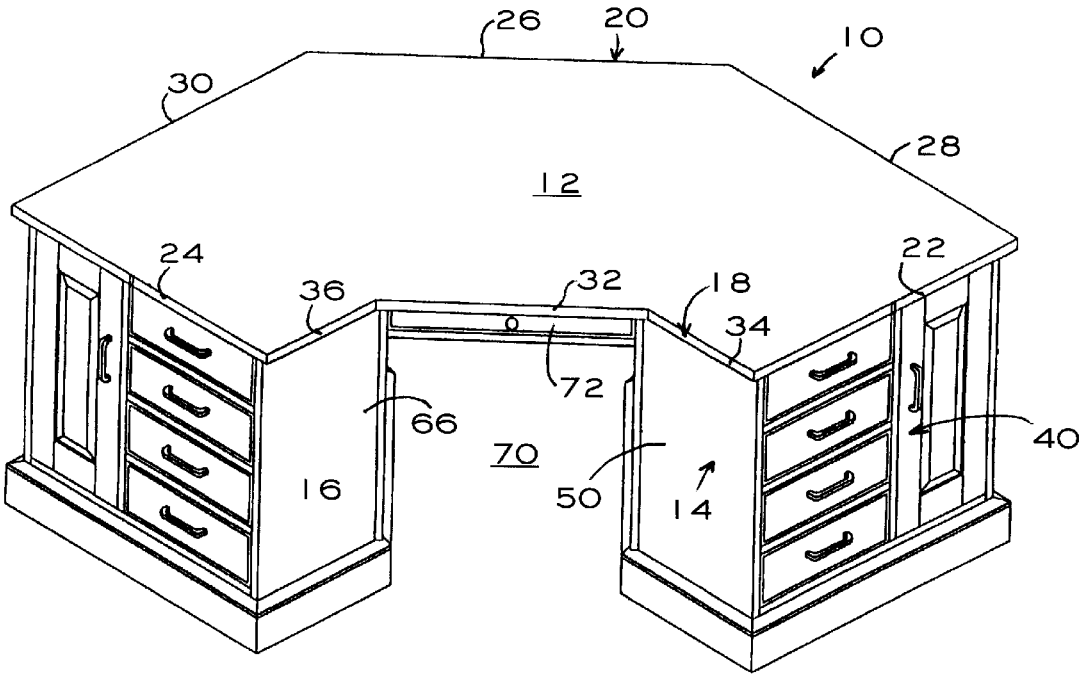
FIG. 1 is a perspective view of a first embodiment of a computer desk according to the present invention showing the rear, or the work area side, of the desk.
Figure 2:
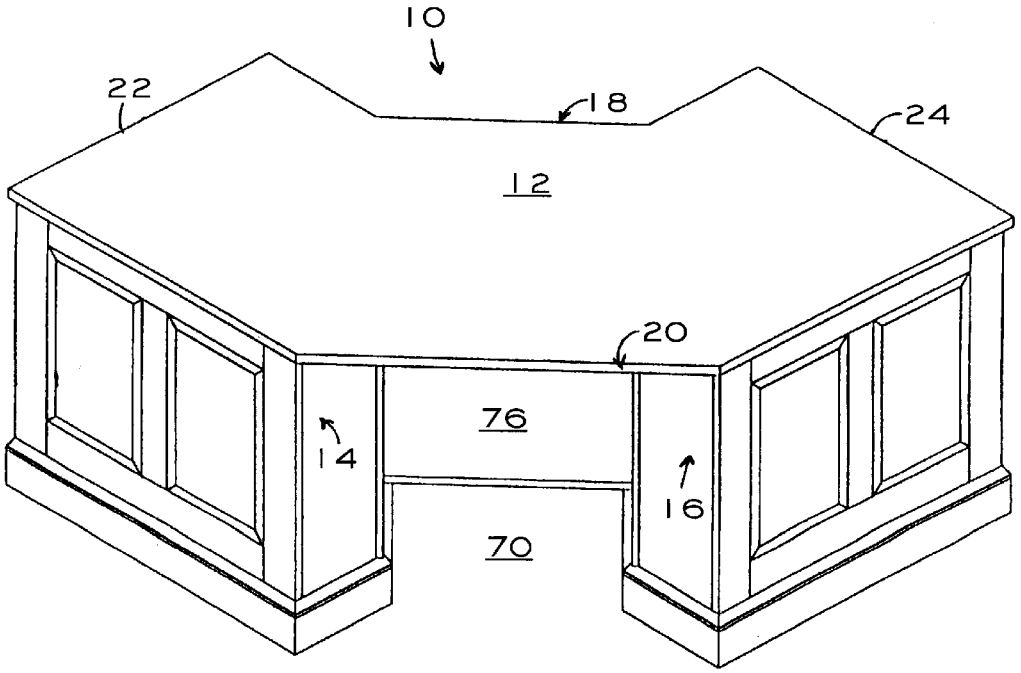
FIG. 2 is a front perspective view of the first embodiment of a computer desk.
Figure 3:
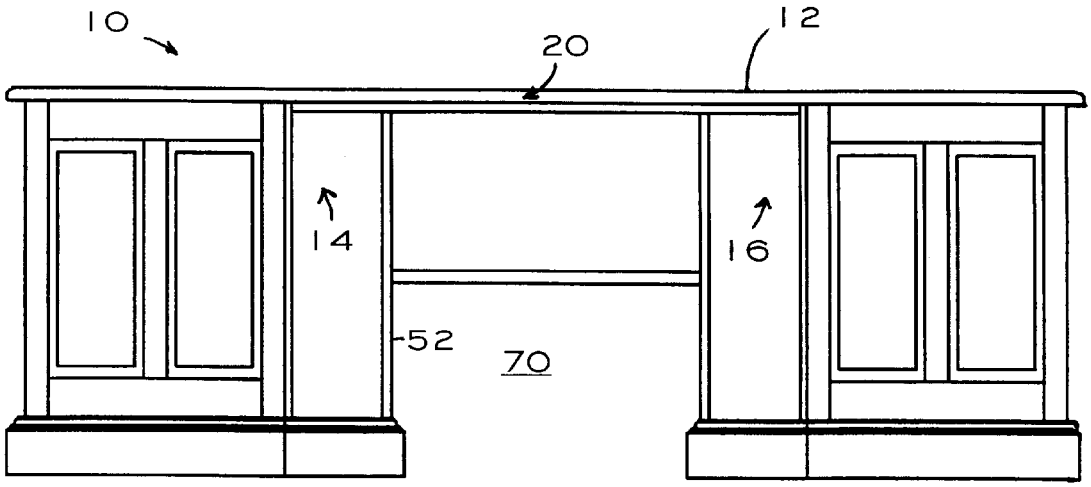
FIG. 3 is a front elevational view of the first embodiment of a computer desk.
Figure 4:
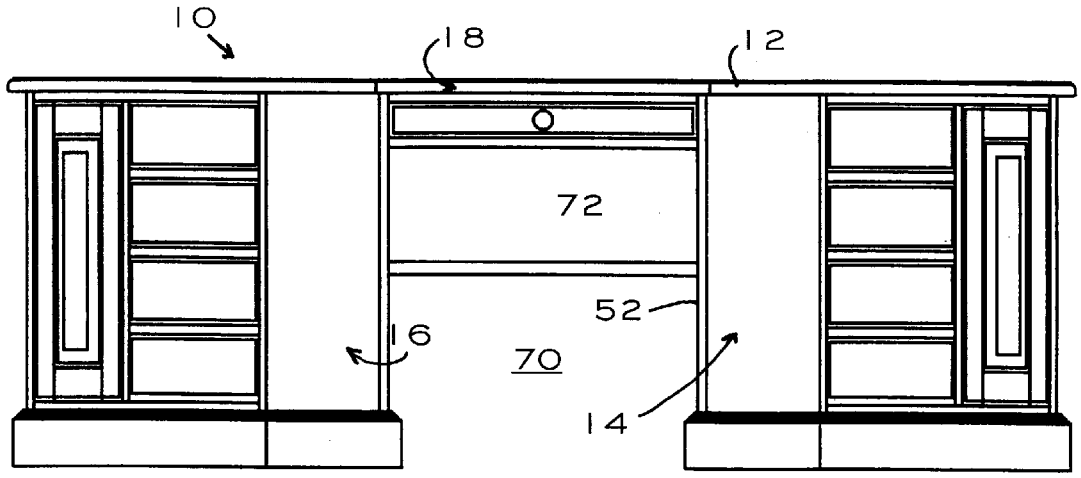
FIG. 4 is a rear, or work side, elevational view of the first embodiment of a computer desk.

Referring to FIGS. 1–7, a first embodiment of a computer desk according to the present invention is generally shown at 10. The desk 10 has a generally C-shaped top 12, which is supported in a generally horizontal position by a first pedestal 14 and a second pedestal 16. As illustrated, the C-shaped top 12 has a concave side 18 and a convex side 20, with the convex side 20 being longer than the concave side 18. The concave and convex sides are interconnected by a first end 22 and a second end 24.

For ease of reference, the convex side 20 of the top 12 and desk 10 will also be referred to as a back side or work side and the concave side 18 will also be referred to as a front side. A user of the desk 10 would typically sit at a chair positioned on the work side 18 and a visitor would typically sit on the opposite or front side 20 of the desk 10. Because of the C-shaped configuration of the top 12, with the convex side 20 being longer than the concave side 18, the top 12 wraps partially around the user of the desk 10 when the user is seated on the work side 18. This increases the usable desk top space within easy reach of the person.

Figure 5:
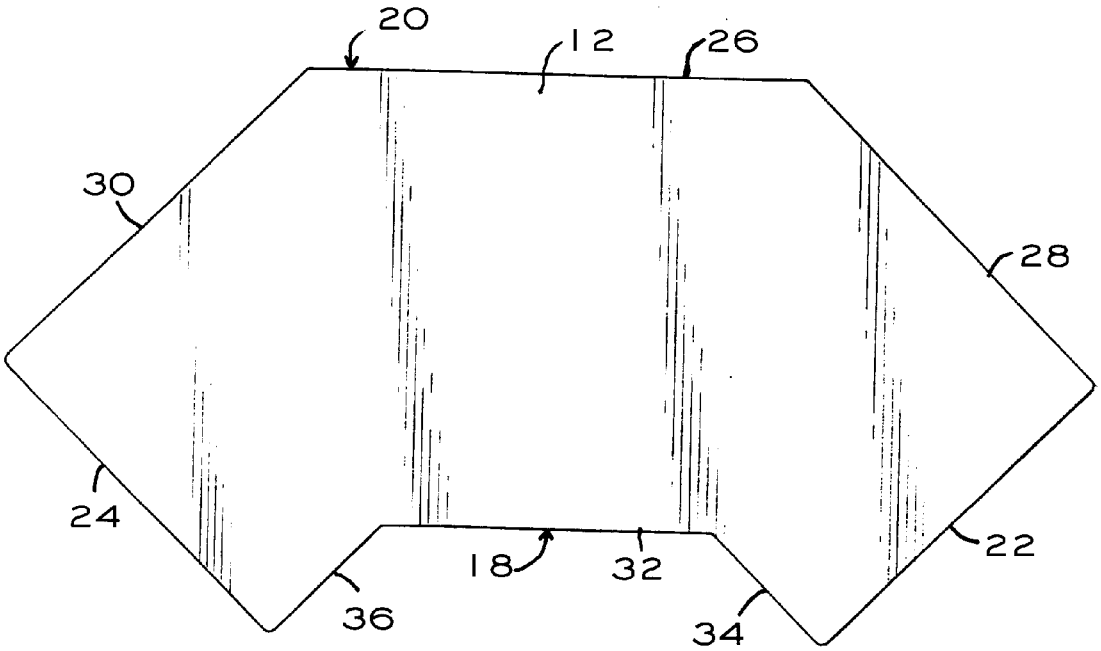
FIG. 5 is a top plan view of the first embodiment of a computer desk.

As best illustrated in FIG. 5, the convex side 20 of the top 12 is made up of three linear portions. For ease of reference, the central portion will be referred to as the central linear portion 26 and the linear portions to each side of the central linear portion 26 will be referred to as a first side portion 28 and a second side portion 30. The first side portion 28 is adjacent the first end 22 and the second side portion 30 is adjacent the second end 24. Likewise, the concave side 18 is made up of three linear portions defined as a central linear portion 32, a first side portion 34, and a second side portion 36. In this first preferred embodiment of the present invention, the central linear portion 26 of the convex side 20 is generally parallel to the central linear portion 32 of the concave side 18 of the top 12. The central linear portions 26 and 32 are spaced apart by a distance of at least 28–30 inches, and preferably approximately 34–36 inches. Likewise, the first side portion 28 of the convex side 20 is generally parallel to the first side portion 34 of the concave side 18 and spaced apart by a distance of 24–30 inches, and preferably approximately 28–30 inches. The second side portions 30 and 36 are also generally parallel and spaced apart by a distance of 24–30 inches. The top 12 may be considered to have three general areas: a central area, and two side areas. The central area is the portion of the desk between the two central linear portions 26 and 32, and the side portions are the two adjacent portions. When viewed from the top, the side portions generally extend from the central portion at a 45 degree angle thereto. Obviously, other dimensions and angles are possible without defeating the purposes or advantages of the present invention.

Figure 7:
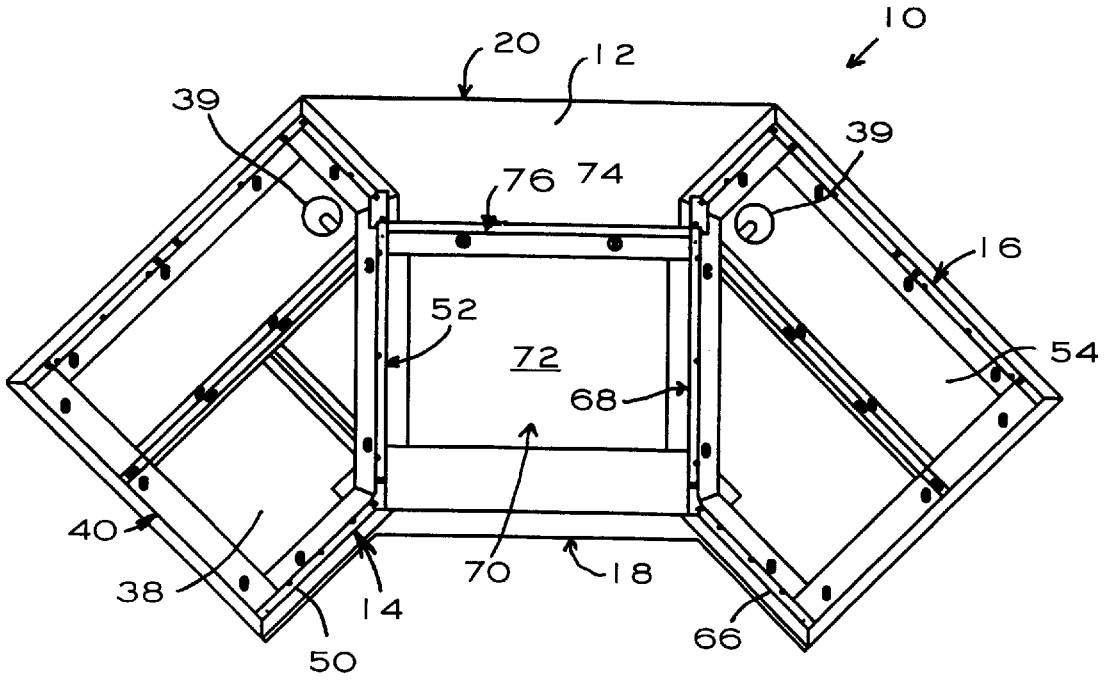
FIG. 7 is a bottom plan view of the first embodiment of a computer desk.
Figure 9:
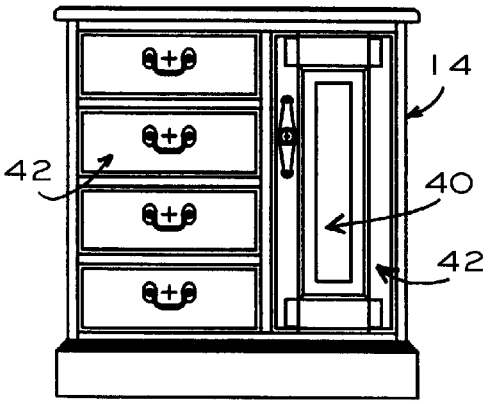
FIG. 9 is an elevational view of a first end of the first embodiment of a computer desk.
Figure 10:
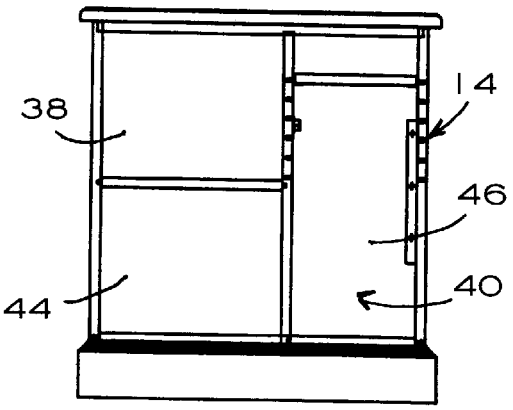
FIG. 10 is an elevational view of the first end of the computer desk with the face removed so as to show the internal storage compartments.

Turning now to the pedestals, the first pedestal 14 is configured to support the top 12 in its generally horizontal position. As best shown in FIG. 7, the first pedestal 14 preferably has five side faces and defines an interior storage space 38, bounded by the five side faces. Access to the interior storage space 38 is provided through an opening in one of the side faces, which will be defined herein as a first face 40. FIGS. 9 and 10 show a view of this first face 40 of the first pedestal 14. FIG. 9 shows the first face 40 with the opening covered by doors or drawers 42. FIG. 10 shows the first face 40 with the doors and drawers 42 removed so that the opening 44 may be seen. Preferably, the interior storage space 38 is divided into a plurality of smaller storage spaces so that a variety of items may be conveniently stored. As will be clear to those of skill in the art, this configuration of the interior storage space 38 may be varied in many ways depending on the application and the type of items to be stored.

In the illustrated embodiment, the interior storage space 38 is divided so as to provide a relatively large vertical space 46 for housing a tower type computer processing unit. This large vertical space 46 is positioned towards the right side of the interior storage space 38 thereby positioning the computer processing unit stored therein at a position farther from a user sitting at the desk 10. It is envisioned that a user will need less frequent access to the processing unit than the other items in the desk, and therefore positioning the processing unit away from the user may be preferred. Also, as best shown in FIG. 7, the portions of the interior space 38 furthest from the user also have the greatest depth, thereby allowing plenty of room for a large processing unit. The greater depth also allows cable routing behind the processing unit. As shown in FIG. 7, access holes 39 may be provided in the desk top 12 for routing cables from the interior storage space 38 to the desk top to connect to monitors or keyboards. This is designed to reduce clutter. Alternatively, as shown in FIG. 5, the desk top may be designed without access holes for a smooth surface finish, or the access holes may be hidden using covers that blend into the desk top 12.

Referring back again to FIGS. 9 and 10, the left portion of the interior storage space 38 may be used in a variety of ways. As illustrated, the space is divided into an upper and lower area, both of which are designed to accept a filing drawer for holding standard or legal size hanging file folders. In this respect, the numeral 42 is used to designate either doors or drawers. Obviously, this configuration can be altered so as to provide a plurality of smaller drawers, a mixture of smaller and larger drawers, or other types of storage space. Also, computers come in a variety of configurations and may have a processing unit that is designed to be stored horizontally rather than vertically. In this situation, the interior storage space 38 may be configured to provide a large vertical storage space with the drawers and other storage space positioned around the vertical space. Alternatively, the processing unit could be stored in the other pedestal. Therefore, the configuration shown in FIGS. 9 and 10, and the drawer and door faces 42 are only illustrative of one configuration of the many that are available.

As shown in FIGS. 1–7, the first pedestal 14 is disposed proximate to the first end 22 of the top 12 such that the first face 40 is aligned with the first end 22. Unlike a traditional desk, this allows access to the interior storage space 38 in the first pedestal 14 through what is essentially an end of the desk 10. Because the desk 10 and the top 12 are generally C-shaped, the end, or first face 40 is positioned within easy reach of a user sitting at the work side 18 of the desk 10. Also, this allows a much larger access opening than if the opening were provided in the face of the pedestal immediately next to the user, and thereby provides more convenience.

Another one of the side faces of the pedestal 14 is defined as a second face 50 and is preferably solid and aligned with a portion of the concave side 18 of the top 12. The second face 50 is adjacent the first face 40. Specifically, the second face 50 of the first pedestal 14 is aligned with the first side portion 34 of the concave side 18 of the top 12. As will be clear to those of skill in the art, the second face 50 could alternatively have one or more openings therein to allow access to the interior storage space 38. For example, a small covered opening may be desirable for access to small objects such as pencils.

Referring back to FIG. 7, the five side faces of the first pedestal 14 are shown. For ease of reference, an additional one of these side faces will now be defined as a third face 52. The third face 52 is adjacent the second face 50. This third face 52 meets the adjacent faces at a non-perpendicular angle so as to provide knee space under the top 12 of the desk 10.

Figure 11:
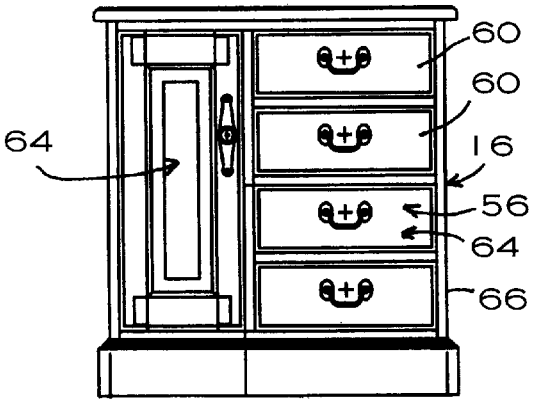
FIG. 11 is an elevational view of a second end of a first embodiment of the computer desk.
Figure 12:
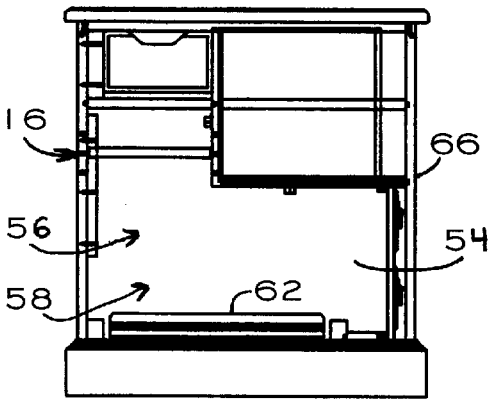
FIG. 12 is an elevational view of the second end of the computer desk with the face removed so as to show the internal storage compartments.

Referring now to FIGS. 7, 11, and 12, the second pedestal 16 will be described. As illustrated, the second pedestal 16 is preferably essentially symmetrical to the first pedestal 14, having five side faces and an interior storage space 54 defined therein. As will be clear to those of skill in the art, the second pedestal 16 may be of a different configuration than the first pedestal 14 and, in fact, may be eliminated or replaced with some other type of support for the top 12. However, it is preferred that a second pedestal 16, such as illustrated, is provided so that storage space may be maximized. Like the first pedestal 14, the second pedestal 16 has a first face 56 with an access opening 58 defined therein for providing access to the interior storage space 54. Once again, the interior storage space 54 is divided into a plurality of smaller storage spaces. In fact, as shown, it may be preferred to provide drawers 60 for the storage of such things as pencils and other small office supplies. Also as illustrated, the interior storage space 54 may be configured to hold a large printer such as a laser printer on a slide-out shelf 62. Doors 64 are configured so as to swing out of the way to allow access to the slide-out shelf 62. Also, as is sometimes used with home entertainment storage cabinets, the doors 64 may slide back into the pedestal 16 so as to be out of the way.

Figure 6:
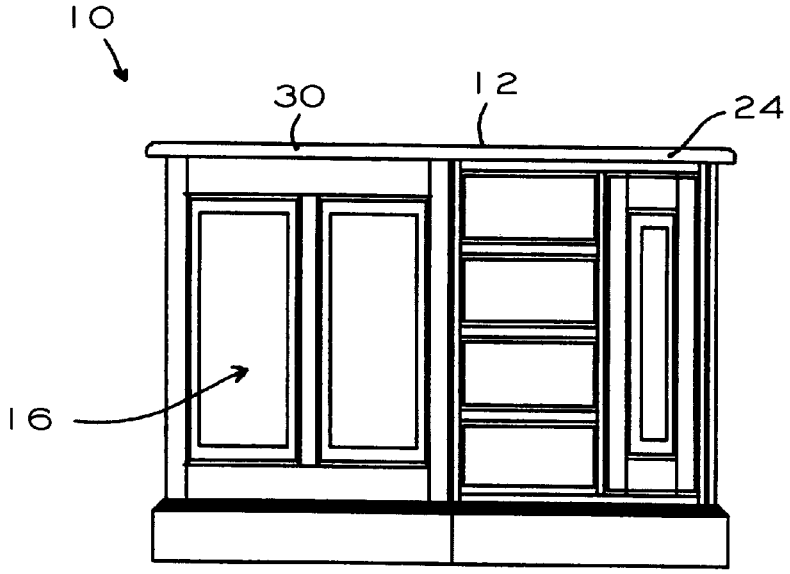
FIG. 6 is a right side elevational view of the first embodiment of a computer desk.

Like the first pedestal 14, the second pedestal 16 has a side face, adjacent the first face 56, which is defined as a second face 66 and another side face, adjacent the second face 66, that is defined as a third side face 68. The third side face 68 meets its adjacent side faces at a non-perpendicular angle so as to provide space under the center of the desk for a knee space for a user. The second pedestal 16 is disposed proximate to the second end 24 of the top 12 with its first face 56 aligned with the first end 22 of the top 12 and its second face 66 aligned with the second side portion 36 of the concave side 18 of the top 12. Once again, the configuration illustrated for the second pedestal is only one of many possible configurations. For example, FIG. 6 shows an alternative configuration wherein the position of the various doors and drawers is reversed. Also, in FIGS. 11 and 12, one of the doors 64 is designed to look like drawer faces to give a symmetrical appearance. Other appearances and configurations are also possible.

Referring again to FIG. 7, the positioning of the first and second pedestals will be further discussed. As shown, the first pedestal 14 and the second pedestal 16 are separate from one another with their respective third faces 52 and 68 being generally parallel to one another and spaced apart so as to define a knee space or knee hole therebetween. For reference, the knee hole will be given the reference numeral 70. The knee hole 70 is important to the comfort of the user because it allows the user to move their chair close enough to the central portion 32 of the concave side 18 of the desk top 12 to work comfortably without restricting movement of their legs and knees. Preferably, the knee hole 70 is approximately 24 inches wide. The knee hole 70 is generally aligned with the space under the center of the top 12, which corresponds to a portion of the area between the respective central linear portions 26 and 32 of the convex 20 and concave 18 sides of the desk top 12. The pedestals 14 and 16 therefor occupy the space under the side portions of the top 12, which are generally defined by the areas between the respective first side portions 28 and 34 and between the second side portions 30 and 36. It is preferred that a back panel 76 extend between the third faces 52 and 68 of the pedestals 14 and 16. This back panel 76 extends downwardly from the underside of the desk top 12 part way to the floor. This back panel provides privacy to a user by preventing a view of their legs and also provides some structural reinforcement to the desk.

Because it is envisioned that a user will be using a computer at the desk 10, the central portion of the top is provided with a drawer or slide-out shelf 72 connected to the underside of the central portion of the top 12 above the knee hole 70. The drawer or slide-out shelf 72 preferably is designed to accommodate a keyboard and pointing device, but may alternatively or additionally accommodate items such as pencils and other office supplies. As shown in FIG. 7, a channel 74 may be attached to the underside of the desk top 12 behind the rear of the drawer 70 for routing cables between the pedestals 14 and 16. As will be clear to those of skill in the art, this channel may be of various designs and provide the advantage of hiding and routing cables. Also, one or more faces of one or both of the pedestals may be provided with ventilation holes for allowing equipment stored within the desk 10 to cool. For example, vent holes may be cut into the third face of one of the pedestals. Also, the desk may be provided with an auxiliary cooling unit such as a small fan to move air through the enclosed space.

Figure 8:
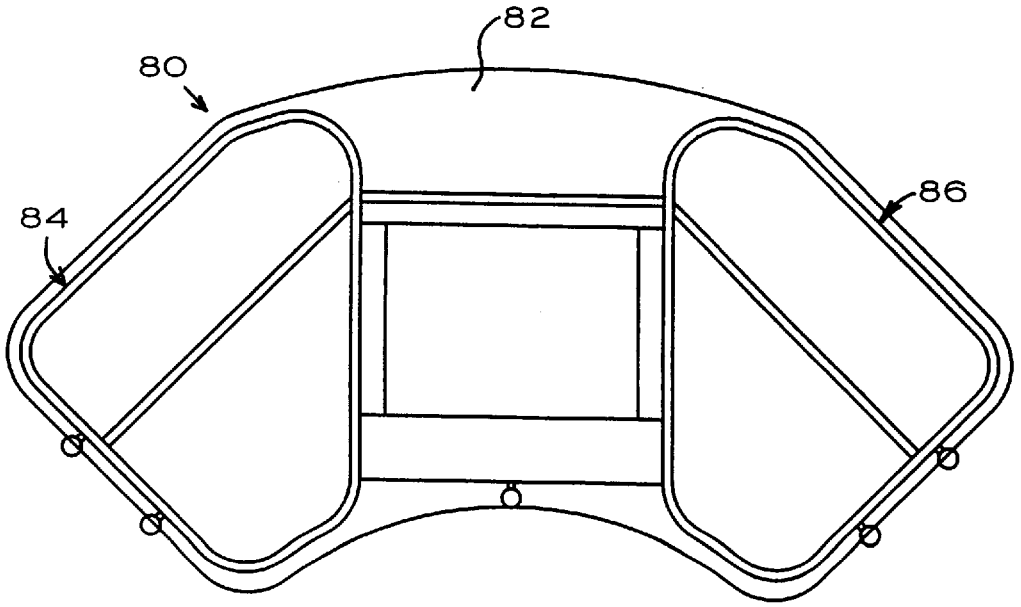
FIG. 8 is a bottom plan view of a second embodiment of a computer desk according to the present invention.

Referring now to FIG. 8, a bottom plan view of a second embodiment of a computer desk according to the present invention is generally shown at 80. This embodiment differs from the prior embodiments in that the top 82 and pedestals 84 and 86 of the desk 80 have rounded comers to give a softer look to the desk 80. This variation on a desk according to the present invention may be more suitable to offices wherein a softer or more amorphous look is desired while still achieving the benefits attributable to the present invention.

A decided advantage to the present invention is the way in which a desk according to the present invention makes use of space within a room. This advantage may be illustrated by comparison to a traditional rectangular desk. FIGS. 13 and 14 illustrate a traditional rectangular desk positioned in or adjacent to a corner of a room. Many office workers prefer that their desk face out of a corner so as to give a view of the entire office and the entrance to the office. As shown in FIG. 13, a traditional rectangular desk may be positioned close to the comer of the room facing diagonally out of the comer. This is often a preferred position for the person sitting behind the desk. However, this configuration poorly utilizes the space in the office. Assuming that the user would like to have room to walk around the desk on each of its sides, the desk must be positioned a significant distance into the room in order to provide a walkway around the desk. About the minimum comfortable walkway width is 24 inches. As an example, with a traditional rectangular desk, with a 34 inch depth and 72 inch width, almost 60 square feet of floor space is required if the desk is positioned as shown in FIG. 13 with 24 inches between the back wall and the corners of the desk. This floor area is measured by drawing a line perpendicular from each back wall through the outermost corner of the desk. This creates a square that is approximately 60 square feet. The boundaries of the 60 square foot area are shown by the dashed lines. An alternative arrangement is shown in FIG. 14. Where space is more limited, it may be necessary to position a rectangular desk with one of its sides against a side wall, as shown. However, this configuration is typically much less desired as the office occupant cannot walk around both ends of the desk and the proximity of the side wall may feel somewhat claustrophobic.

Figure 15:
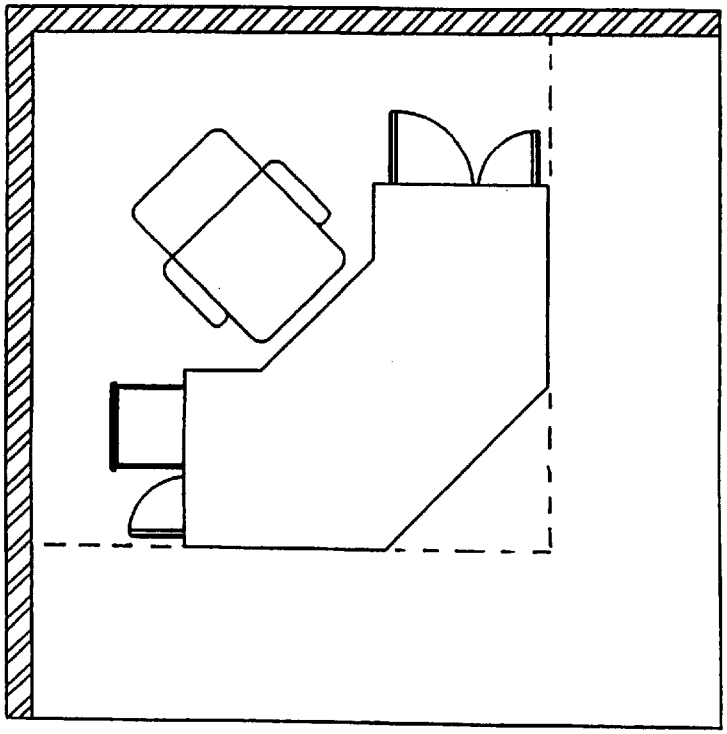
FIG. 15 is a plan view showing a computer desk according to the present invention positioned so as to face out from a corner of a room.

Referring now to FIG. 15, a desk according to the present invention is shown positioned facing out from a comer of a room. If the amount of floor space required for the desk according to the present invention, with the dimensions discussed for the first embodiment, is measured in the same way as for FIG. 13, only approximately 45 square feet of floor space is required. The boundaries of this 45 square foot area are shown by the dashed lines in FIG. 15. Therefore, with a desk according to the present invention, with a desk top surface area similar to the traditional desk shown in FIG. 13, and with increased usable storage space, the required floor space may be reduced by up to 25%.

Figure 16:
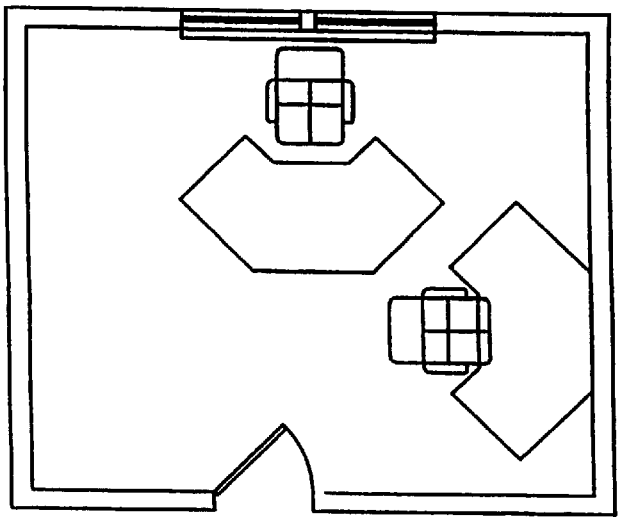
FIG. 16 is a plan view showing two computer desks according to the present invention positioned in a small room.
Figure 17:
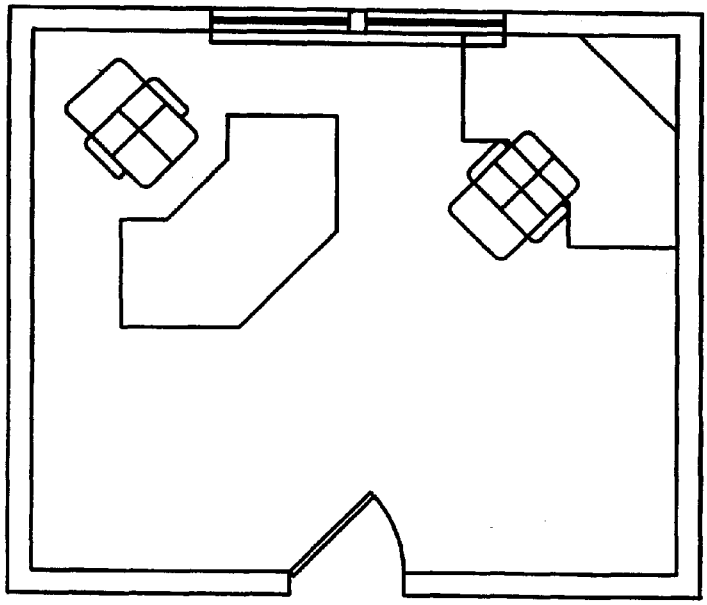
FIG. 17 is a plan view similar to FIG. 16 with the computer desks repositioned into a different configuration within the small room.
Figure 18:
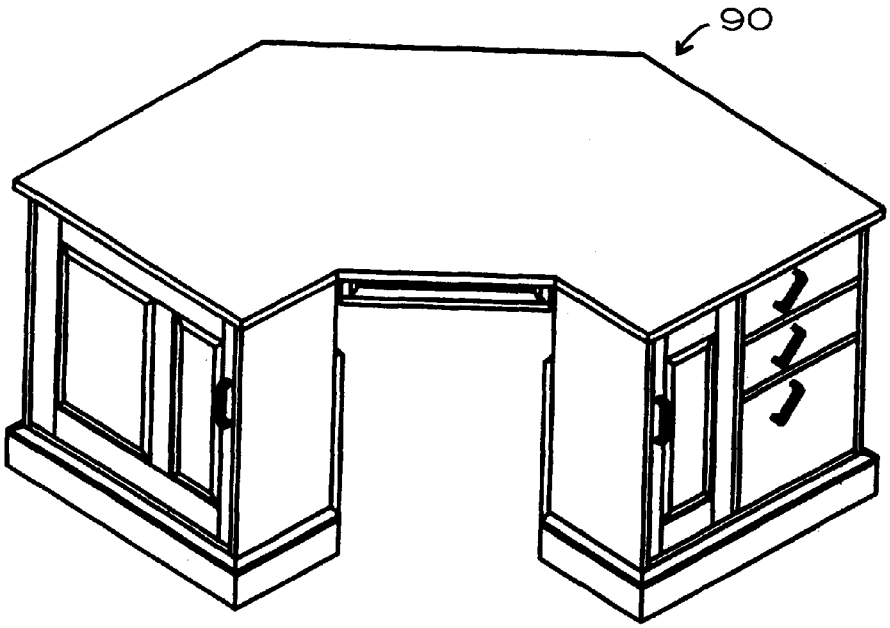
FIG. 18 is a perspective view of a third embodiment of the computer desk according to the present invention showing the rear, or work side, of the desk.
Figure 19:
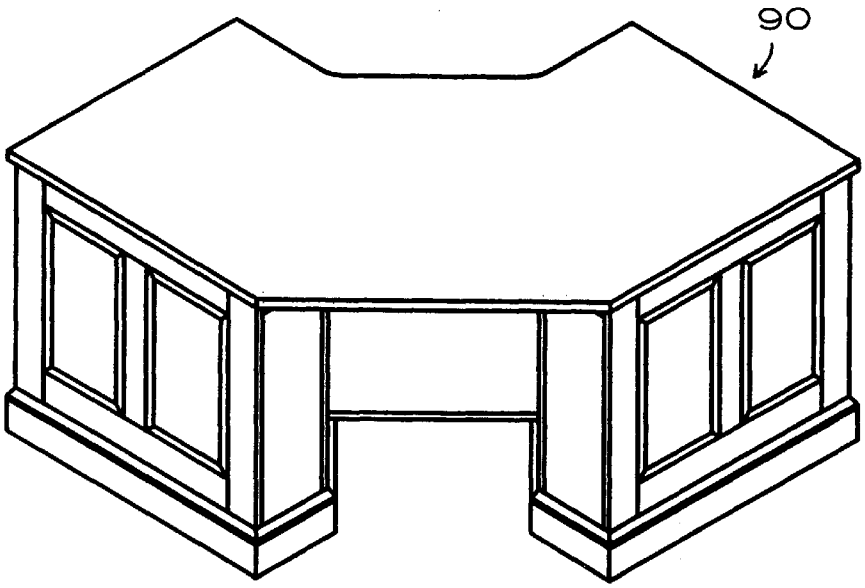
FIG. 19 is a front perspective view of the third embodiment of a computer desk.
Figure 20:
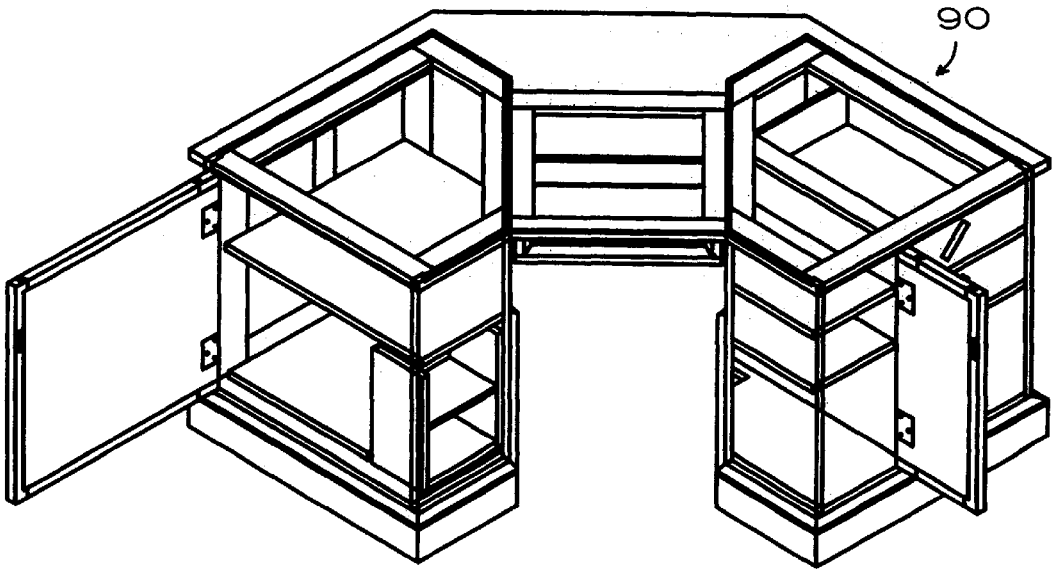
FIG. 20 is a cut-away rear, or work side, perspective view of the third embodiment of the computer desk showing the internal storage of the computer desk.
Figure 21:
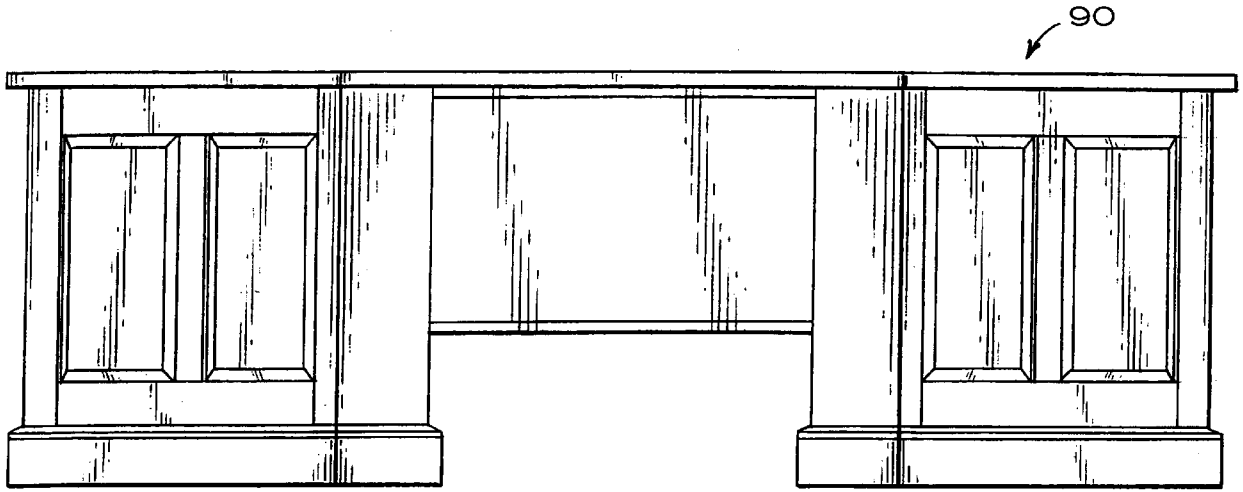
FIG. 21 is a front elevational view of the third embodiment of the computer desk.
Figure 22:
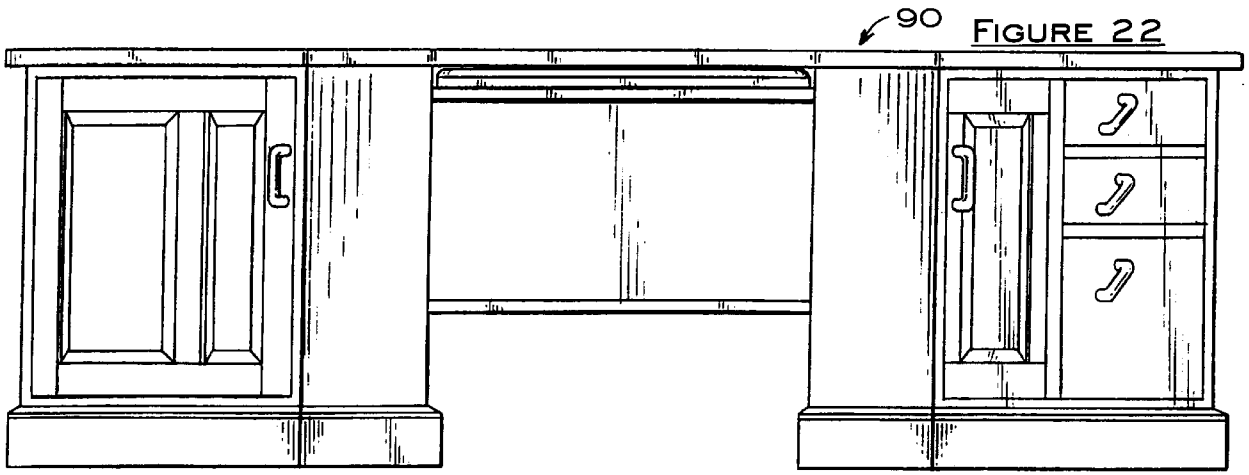
FIG. 22 is a rear, or work side, elevational view of the third embodiment of the computer desk.
Figure 23:
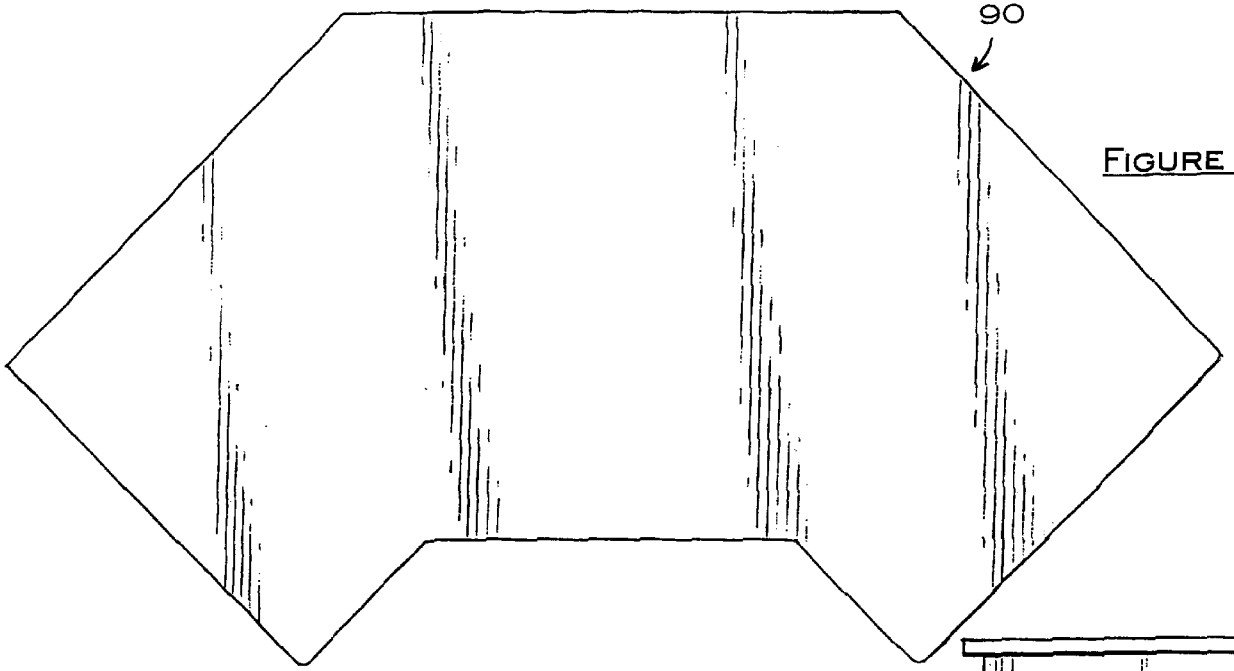
FIG. 23 is a top plan view of the third embodiment of the computer desk.
Figure 24:
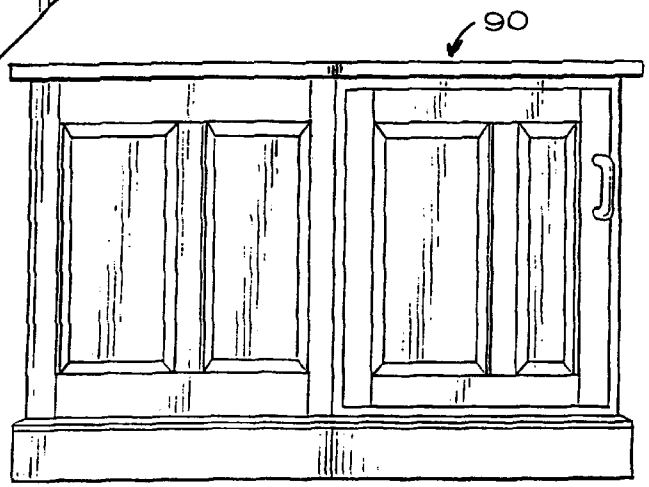
FIG. 24 is a right side elevational view of the third embodiment of the computer desk.
Figure 25:
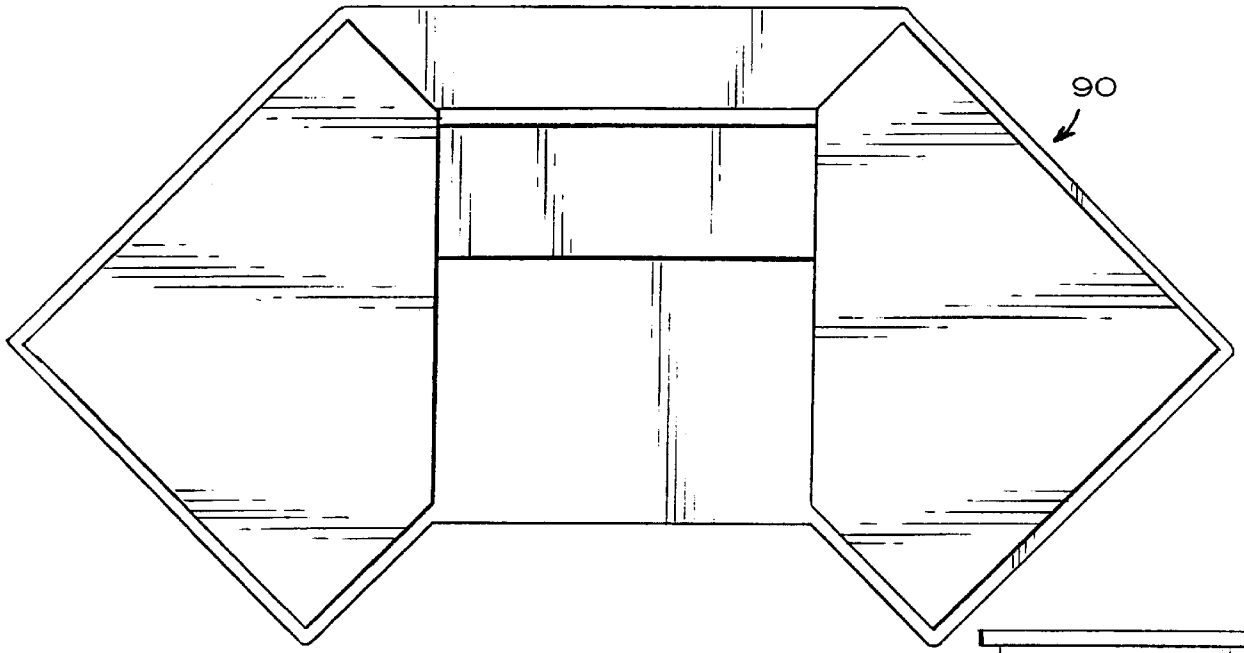
FIG. 25 is a bottom plan view of the third embodiment of a computer desk.
Figure 26:
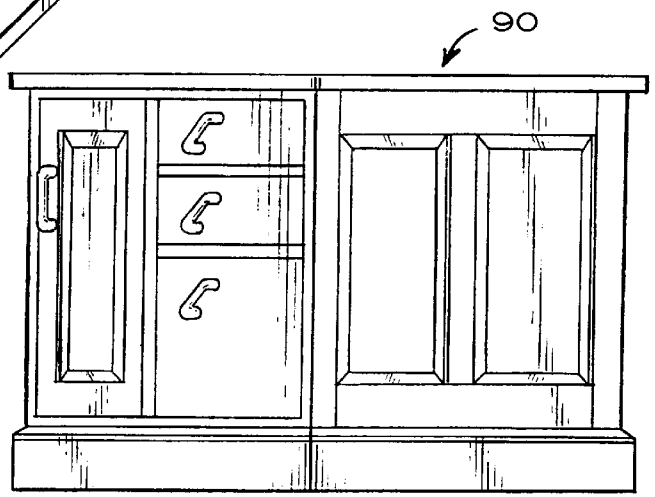
FIG. 26 is a left side elevational view of the third embodiment of the computer desk.
Figure 27:
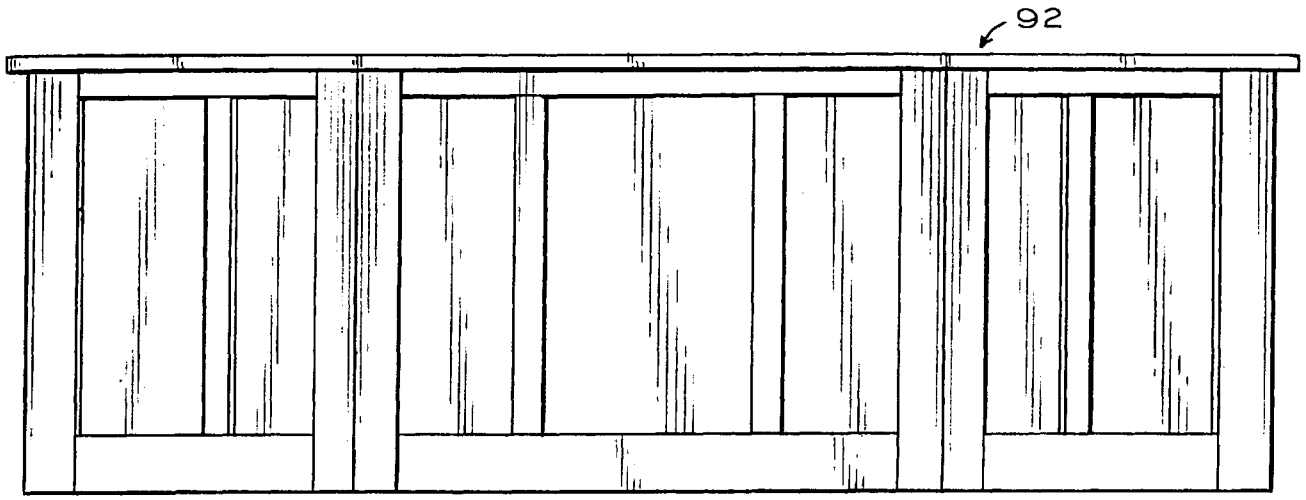
FIG. 27 is a front elevational view of a fourth embodiment of a computer desk according to the present invention.
Figure 28:
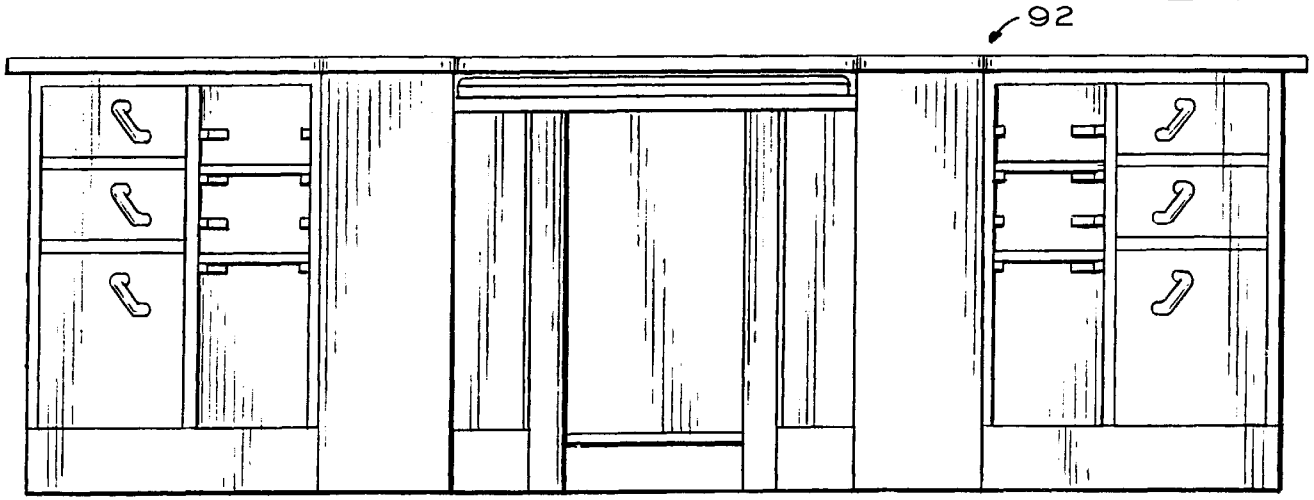
FIG. 28 is a rear, or work side, elevational view of the fourth embodiment of a computer desk.
Figure 29:
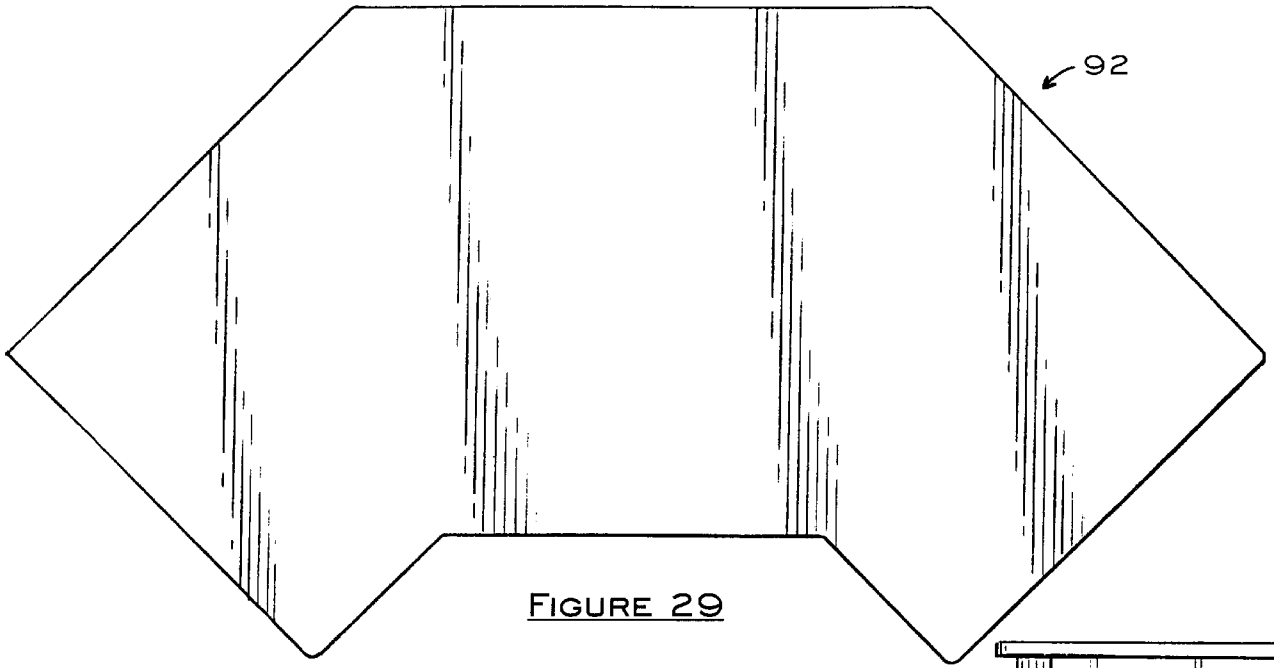
FIG. 29 is a top plan view of the fourth embodiment of a computer desk.
Figure 30:
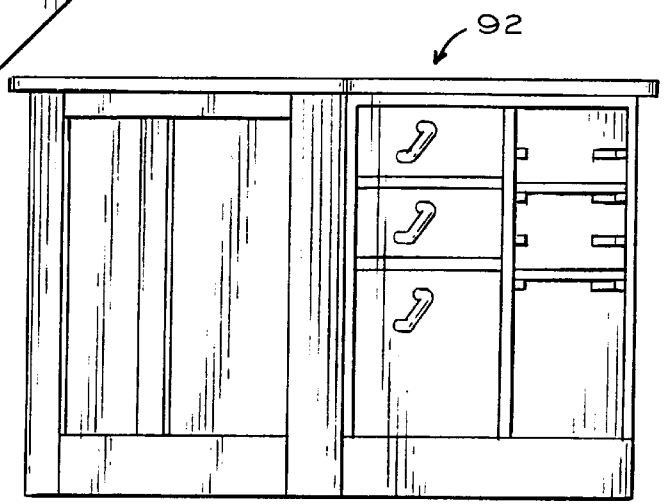
FIG. 30 is a right side elevational view of the fourth embodiment of a computer desk.
Figure 31:
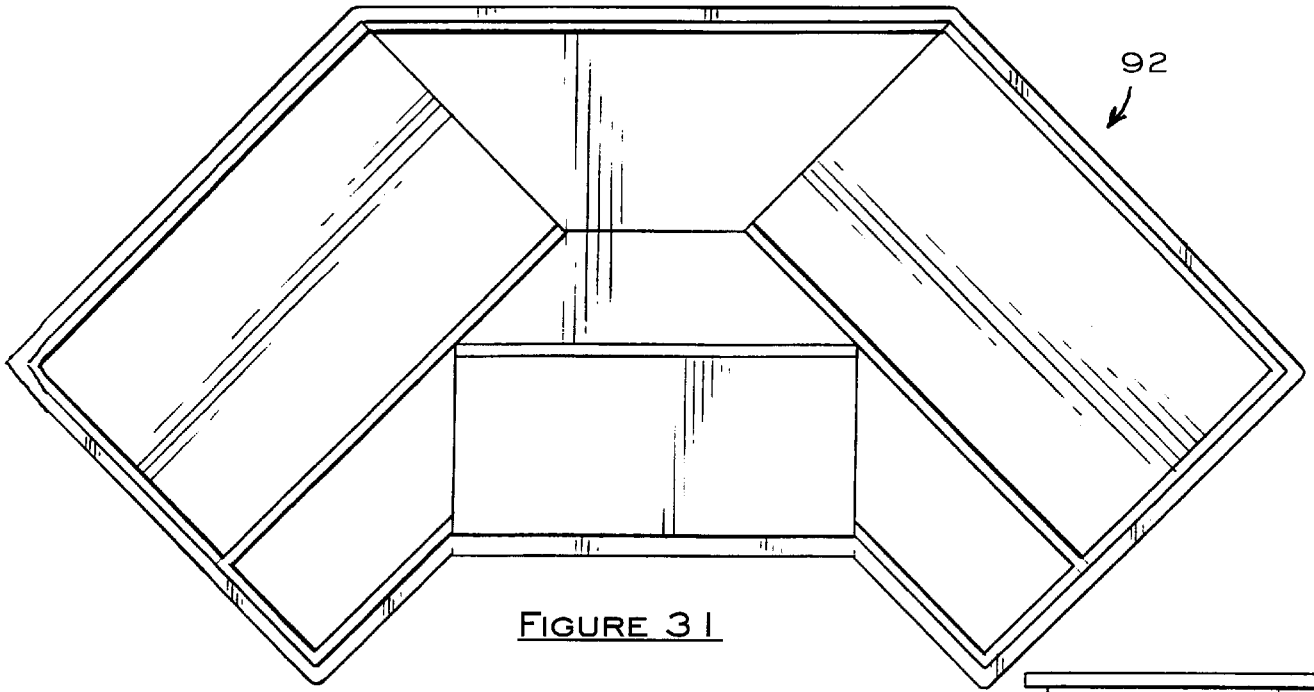
FIG. 31 is a bottom plan view of the fourth embodiment of a computer desk.
Figure 32:
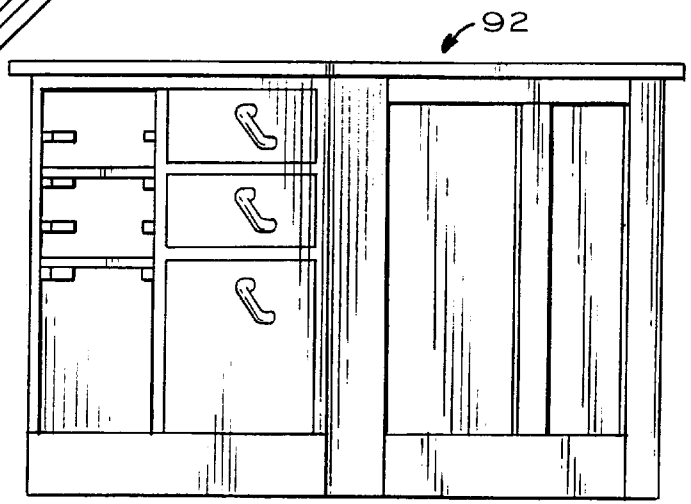
FIG. 32 is a left side elevational view of the fourth embodiment of a computer desk.
Figure 33:
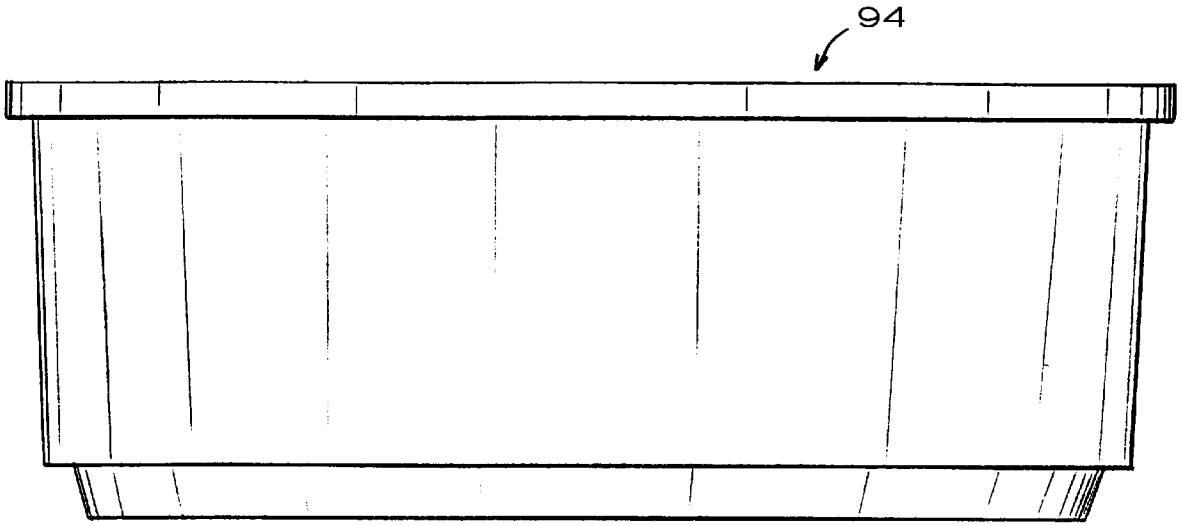
FIG. 33 is a front elevational view of a fifth embodiment of a computer desk according to the present invention.
Figure 34:
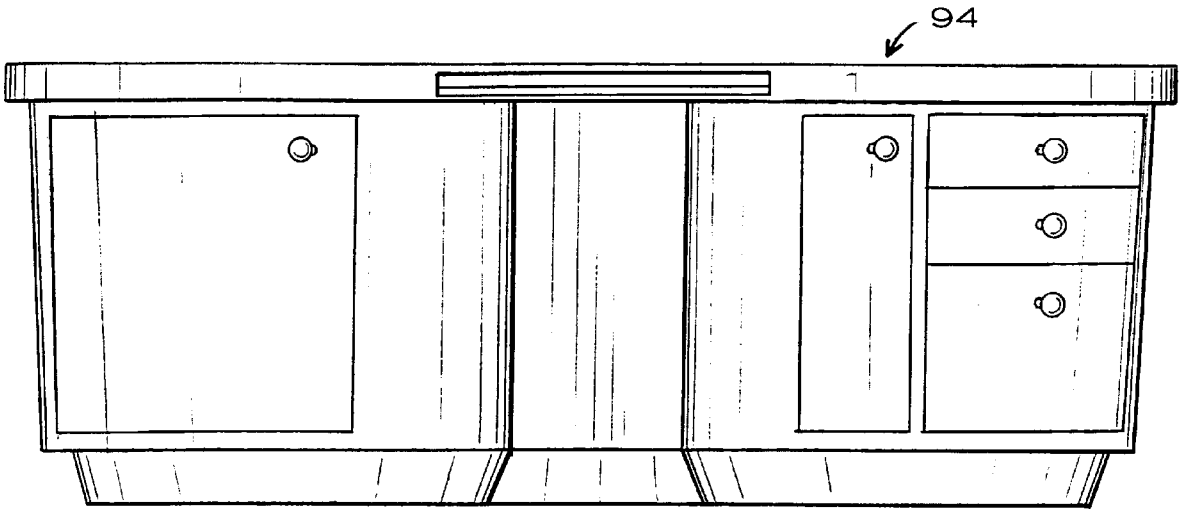
FIG. 34 is a rear, or work side, elevational view of the fifth embodiment of the computer desk.
Figure 35:
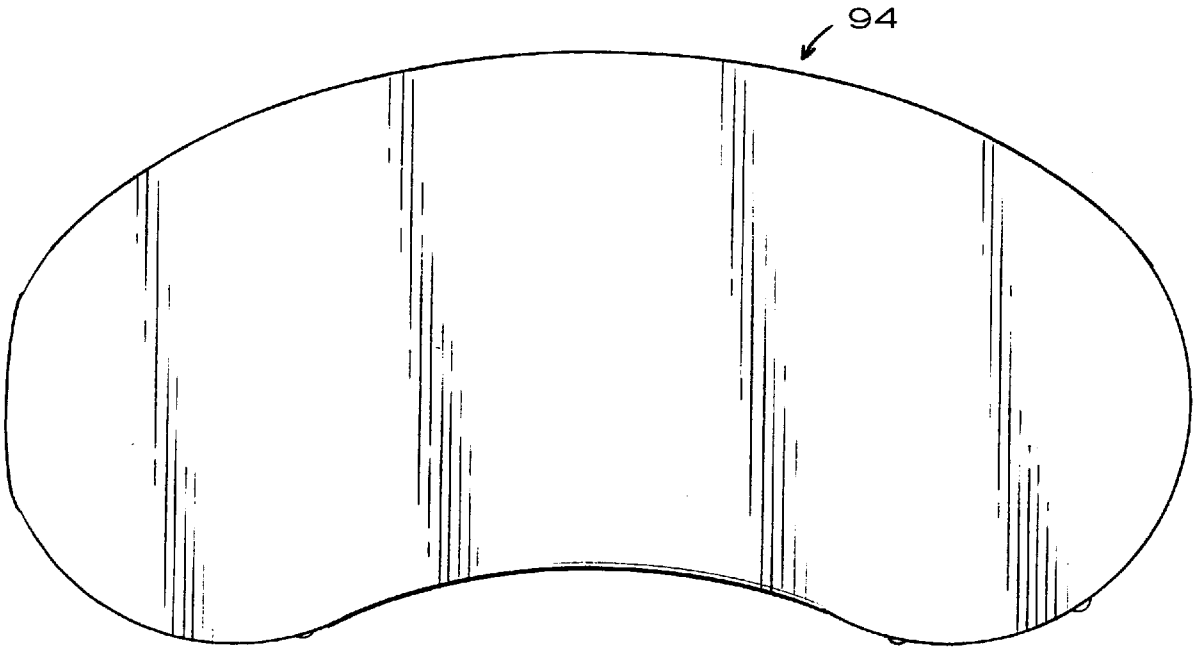
FIG. 35 is a top plan view of the fifth embodiment of a computer desk.
Figure 36:
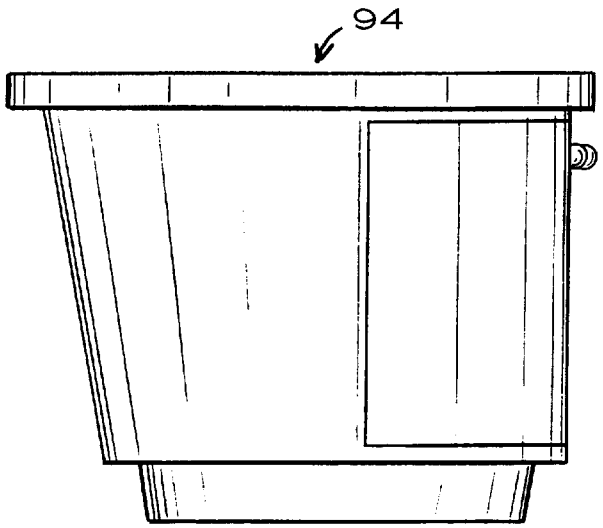
FIG. 36 is a right side elevational view of the fifth embodiment of a computer desk.
Figure 37:
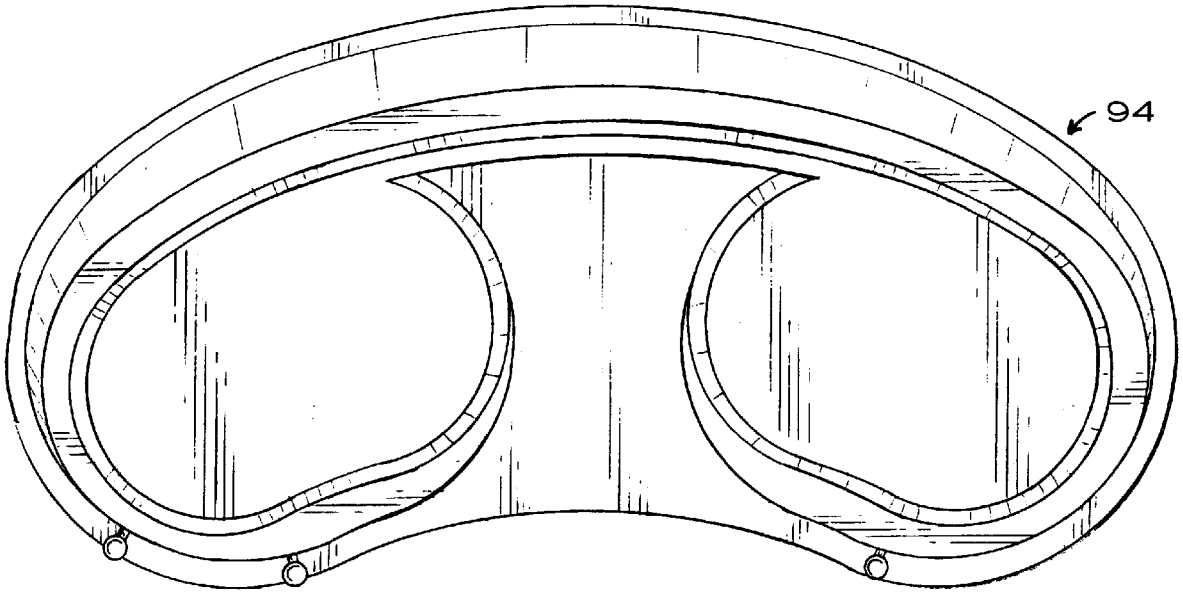
FIG. 37 is a bottom plan view of the fifth embodiment of a computer desk.
Figure 38:
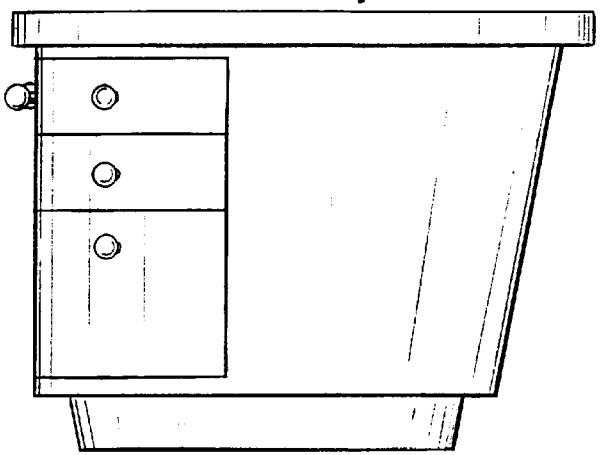
FIG. 38 is a left side elevational view of the fifth embodiment of a computer desk.

Referring now to FIGS. 16 and 17, desks according to the present invention are shown in various positions in a standard room to illustrate the space saving benefits. While most users prefer that they sit facing outwardly, a desk according to the present invention may also be positioned against a wall or facing into a comer if desired.

Another advantage is that a desk according to the present invention generally is easier to move into and out of offices through doorways and other openings than other types of desks with similar storage volume and desk top surface area. For example, referring back to FIGS. 1–7, the preferred embodiment of the present invention has a dimension between 28 and 30 inches between the convex and concave sides of the desk when measured between corresponding side portions 28 and 34, or 30 and 36. Therefore, that portion of the desk may be positioned through a doorway or other opening with a width slightly greater than the width of the desk top. As discussed previously, the distance between the corresponding central portions 26 and 32 of the convex and concave sides is greater than the width between the side portions. Therefore, once the side portion is positioned through a doorway, the entire desk may be rotated so as to take advantage of the decreased dimension, top to bottom, in the knee hole space. In this way, the central portion of the desk may be positioned through the doorway, once the desk has been rotated 90 degrees. The desk may then be rotated back to horizontal and the other end portion moved through the doorway. Therefore, a desk with the dimensions just discussed may be positioned through a doorway as narrow as 29 inches. A large executive desk may have a depth as much as 34 inches and width as great as 6 feet to give comparable desk top surface area and interior storage volume. A desk of this size typically requires a doorway greater than 30 inches wide, the height of the desk, to move the desk into and out of the office. Many offices do not have doorways this wide and therefore cannot accommodate such a large desk. Alternatively, construction may be required to transfer such a desk. A desk according to the present invention, on the other hand, with appropriately chosen dimensions, may be moved through a much smaller doorway and therefore provide the generous storage space and desk top surface area normally associated with a much harder to move desk.

Thus far, two embodiments of a desk according to the present invention have been illustrated. Additional embodiments are also illustrated herein as further examples of configurations that may be preferred. FIGS. 18–26 illustrate a third preferred embodiment of the present invention with somewhat smaller dimensions than those discussed for the first preferred embodiment. A desk according to this third preferred embodiment is generally shown at 90 in each of the figures. As shown, this embodiment has different configurations of drawers and doors.

A fourth preferred embodiment of the present invention is generally shown at 92 in FIGS. 27–32. This fourth preferred embodiment has dimensions similar to those of the third embodiment but has a different storage configuration. It should be noted that this embodiment also has a reduced knee hole area in order to increase the storage space available in the pedestals. Obviously, the various configurations may be altered or combined so as to change the available knee hole space versus the available storage space.

A fifth preferred embodiment of the present invention is generally shown at 94 in FIGS. 33–38. This fifth embodiment, like the second embodiment, is a more amorphous shaped desk that may be more suitable for certain office environments.

In view of the teaching presented herein, other modifications and variations of the present inventions will be readily apparent to those of skill in the art. For example, the work side 18 of the desk top 12 could be made straight rather than concave. This would reduce the wrap-around effect of the desk somewhat and make the desk harder to move, but would still provide the storage advantages associated with the present invention. The foregoing drawings, discussion, and description are illustrative of some embodiments of the present invention; but are not meant to be limitations on the practice thereof.

I claim:

1. A computer storing desk for housing and supporting computer hardware, said desk comprising:

a C-shaped top having a concave side defining a work area and a convex side opposite said concave side and greater in length than said concave side, said convex side defining a front edge of said desk, said convex side of said top comprising three linear portions, one of which is a central portion, said concave side of said top comprising three linear portions, one of which is a central portion, and said central portion of said convex side and said central portion of said concave side being generally parallel, said top further having a first end and a second end extending between said concave and said convex sides; and a pedestal configured to support said top and disposed proximate one of said ends, said pedestal defining a storage space therein and having a first face with an access opening defined therein, said opening communicating with said storage space, said pedestal further having a second face which is a solid face with no openings therein, said pedestal disposed so that said second face is aligned with said concave side of said top and first face is aligned with one of said ends.

2. The desk according to claim 1 wherein said first and said second ends of said top are disposed generally perpendicular to each other.

3. A computer storing desk for housing and supporting computer hardware, said desk comprising:

a C-shaped top having a concave side defining a work area and a convex side opposite said concave side and greater in length than said concave side, said convex side defining a front edge of said desk, said top further having a first end and a second end extending between said concave and said convex side;

a first pedestal configured to support said top and disposed proximate said first end of said top, said first pedestal having five side faces; and a second pedestal configured to support said top and disposed proximate said second end of said top, said second pedestal having five side faces;

one of said side faces of said first pedestal being generally parallel to and spaced from one of said side faces of said second pedestal so as to define an area for the knees of a user.

4. The desk according to claim 3 wherein said first pedestal defines a storage space therein, one of said five side faces being a first face and having an access opening defined therein, said opening communicating with said storage space.

5. The desk according to claim 4 wherein said first pedestal is disposed so that said first face is aligned with said first end of said top.

6. The desk according to claim 3 wherein said convex side of said top comprises three linear portions, one of which is a central portion, said concave side of said top comprises three linear portions, one of which is a central portion, and said central portion of said convex side and said central portion of said concave side are generally parallel.

7. A computer storing desk for housing and supporting computer hardware, said desk comprising:

a C-shaped top having a concave side defining a work area and a convex side opposite said concave side and greater in length than said concave side, said convex side defining a front edge of said desk, said convex side of said top comprising three linear portions, one of which is a central portion, said concave side of said top comprising three linear portions, one of which is a central portion, and said central portion of said convex side and said central portion of said concave side being generally parallel, said top further having a first end and a second end extending between said concave and said convex sides; and a first pedestal configured to support said top and disposed proximate one of said ends, said pedestal defining a storage space therein and having a first face with an access opening defined therein, said opening communicating with said storage space, said pedestal further having a second face which is a solid face with no openings therein, said pedestal disposed so that said second face is aligned with said concave side of said top and said first face is aligned with one of said ends; and a second pedestal separate from said first pedestal, configured to support said top and disposed proximate the other one of said ends.

8. The desk according to claim 7 wherein said second pedestal is spaced from said first pedestal so as to define a space for a user's knees.

9. The desk according to claim 7 wherein said first pedestal further comprises a third face, said second pedestal comprises a first, a second, and a third face, said third face of said first pedestal being parallel to and spaced from said third face of said second pedestal so as to define a space for a user's knees.

10. The desk according to claim 7 wherein said second pedestal defines a storage space therein and has a first face with an access opening defined therein, said opening communicating with said storage space, said pedestal disposed so that said first face is aligned with the other one of said ends.

* * * * *